US009387677B2

(12) United States Patent
Kanome et al.

(10) Patent No.: US 9,387,677 B2
(45) Date of Patent: Jul. 12, 2016

(54) INKJET PRINTING APPARATUS

(71) Applicant: CANON KABUSHIKI KAISHA, Tokyo (JP)

(72) Inventors: Yuji Kanome, Yokohama (JP); Hiroyuki Saito, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/803,200

(22) Filed: Jul. 20, 2015

(65) Prior Publication Data

US 2016/0052274 A1 Feb. 25, 2016

(30) Foreign Application Priority Data

Aug. 21, 2014 (JP) ..... 2014-168525

(51) Int. Cl.
*B41J 2/165* (2006.01)
*B41J 2/175* (2006.01)

(52) U.S. Cl.
CPC ..... *B41J 2/16508* (2013.01); *B41J 2/1652* (2013.01); *B41J 2/16523* (2013.01); *B41J 2/17596* (2013.01)

(58) Field of Classification Search
CPC . B41J 2/16508; B41J 2/17596; B41J 2/16505
USPC ..... 347/29–30, 85–86
See application file for complete search history.

(56) References Cited

U.S. PATENT DOCUMENTS 5,245,362 A 9/1993 Iwata et al.
6,062,670 A 5/2000 Iwata et al.
6,109,725 A 8/2000 Saikawa et al.
6,338,541 B1 1/2002 Iwata et al.
6,550,888 B2 4/2003 Iwata et al.
6,565,188 B1 5/2003 Saito
6,641,250 B2 11/2003 Saito
6,712,447 B2 3/2004 Saito
6,722,757 B2 4/2004 Saito
6,951,381 B2 10/2005 Shigeno et al.
7,011,387 B2 * 3/2006 Saito ..... B41J 2/16523 347/29
2005/0030357 A1 * 2/2005 Sakai ..... B41J 2/17503 347/86
2005/0285915 A1 * 12/2005 Shimizu ..... B41J 2/17509 347/85
2010/0103217 A1 * 4/2010 Takase ..... B41J 2/16585 347/30

FOREIGN PATENT DOCUMENTS

JP 2002-36604 A 2/2002

OTHER PUBLICATIONS

Copending, unpublished U.S. Appl. No. 14/822,043 to Hiroyuki Saito, et al., dated Aug. 10, 2015.

* cited by examiner

*Primary Examiner* — Jason Uhlenhake
(74) *Attorney, Agent, or Firm* — Fitzpatrick, Cella, Harper, Scinto

(57) ABSTRACT

To provide an inkjet printing apparatus that can suppress influence by a backflow of the fluid flowing from the pump to the cap. An inkjet printing apparatus includes: an inkjet printing head including an ejection opening face formed with an ejection opening; a cap being capable of sealing the ejection opening face; a tube pump connected with the cap and configured to be able to generate a negative pressure inside of the cap; and a buffer member provided between the cap and the tube pump and having a volume being capable of storing a fluid flowing from the tube pump to the cap.

8 Claims, 5 Drawing Sheets

CROSS SECTION T-T

INKJET PRINTING APPARATUS

BACKGROUND OF THE INVENTION

1. Field of the Invention

The present invention relates to an inkjet printing apparatus, more particularly, to the inkjet printing apparatus that executes a suction-recovery action by using a tube pump.

2. Description of the Related Art

A printing apparatus is known in which an ejection opening face formed with an ejection opening of an inkjet printing head is sealed with a cap, a suction unit such as a pump connected to the cap is activated, and air bubbles and ink having an increased viscosity are suctioned and ejected from an inside or the like of the ejection opening, with the result that ejection performance is recovered.

Japanese Patent Laid-Open No. 2002-036604 discloses a printing apparatus using a tube pump as the suction unit. An axis of a roller in the tube pump of Japanese Patent Laid-Open No. 2002-036604 is supported by a holder so as to be able to be moved between a pressing position where a tube is pressed and a non-pressing position where the tube is not pressed, along a groove having a long-hole geometry formed in the holder. In a configuration according to Japanese Patent Laid-Open No. 2002-036604, the roller presses the tube along with rotation of the holder in one direction and squeezes the tube to thereby exert a pump function, and in the case where the holder is rotated and driven in another direction, the roller is moved toward the non-pressing position.

However, in the configuration according to Japanese Patent Laid-Open No. 2002-036604, since the roller is moved along the groove having the long-hole geometry, the tube may be pressed by the roller to thereby generate a backflow of the fluid flowing from the pump to the cap, until the roller reaches the non-pressing position at the time of rotation of the holder in another direction. In the case where the fluid flowing back reaches the cap, the air bubbles are generated in ink in the cap, and a mixed color in which inks having different colors are mixed may be generated by the contact of the air bubbles with the ejection opening. Furthermore, meniscus formed at the ejection opening is destroyed by the air bubbles to thereby cause gas to flow in the ejection opening, and there may be generated the non-ejection of ink, in which ink is not ejected but the gas is ejected from the ejection opening. As described above, in the case where the backflow of the fluid flowing from the pump to the cap occurs, ink in a desired color may not be applied to a printing medium, or ink may not be applied thereto, with the result that image quality may be deteriorated.

SUMMARY OF THE INVENTION

The present invention provides the inkjet printing apparatus that can reduce influence by the backflow of the fluid flowing from the pump to the cap.

According to a first aspect of the present invention, there is provided an inkjet printing apparatus that includes: an inkjet printing head including an ejection opening face formed with an ejection opening; a cap being capable of sealing the ejection opening face; a tube pump connected with the cap and configured to be able to generate a negative pressure inside of the cap; and a buffer member provided between the cap and the tube pump and having a volume being capable of storing a fluid flowing from the tube pump to the cap.

According to the present invention, the fluid flowing from the tube pump to the cap is stored in the buffer member by provision of the buffer member having a volume being capable of storing the fluid flowing from the tube pump to the cap between the cap and the tube pump, with the result that the influence by the backflow can be suppressed.

Further features of the present invention will become apparent from the following description of exemplary embodiments (with reference to the attached drawings).

DESCRIPTION OF THE EMBODIMENTS

Hereinafter, an embodiment of the present invention will be described in detail with reference to drawings.

Figure 1:
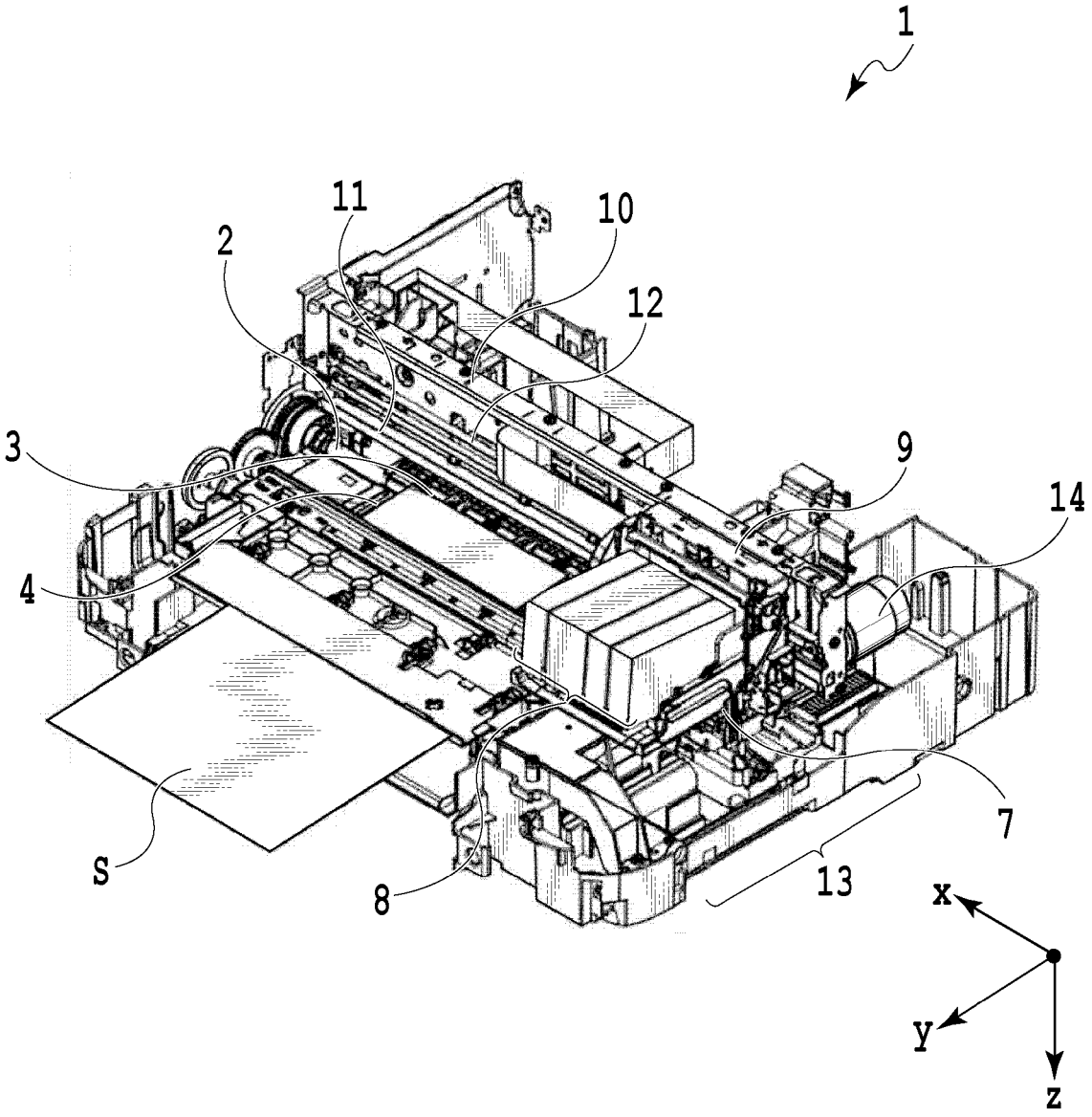
FIG. 1 is a perspective view illustrating a configuration of an inside of an inkjet printing apparatus.
Figure 2:
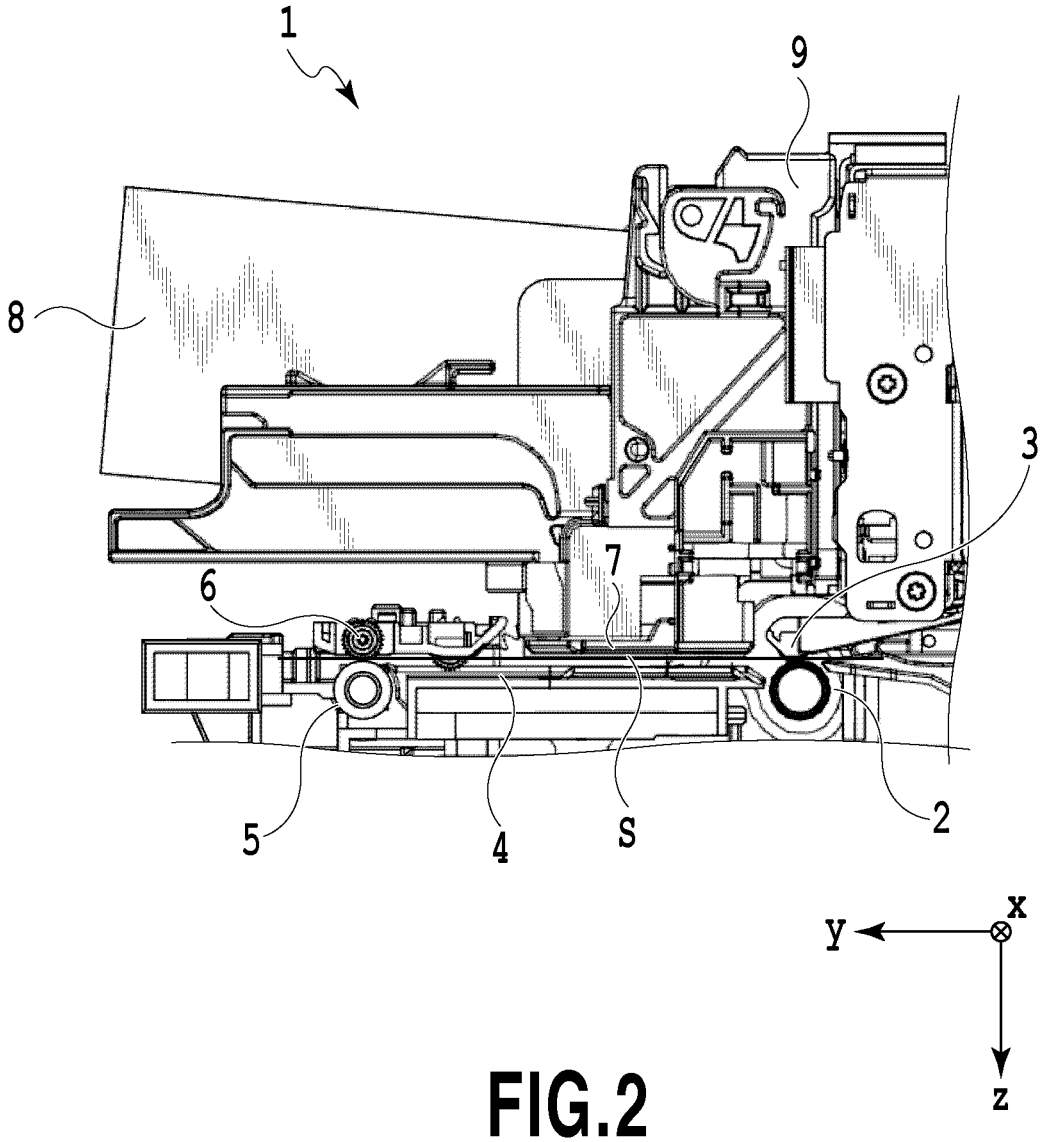
FIG. 2 is a cross-sectional view illustrating the configuration of the inside of the inkjet printing apparatus.

FIG. 1 is a perspective view illustrating a configuration of an inside of an inkjet printing apparatus(hereinafter, referred to as a "printing apparatus") 1 according to the present embodiment.FIG. 2 is a cross-sectional view illustrating the configuration of the inside of the printing apparatus 1. As illustrated in FIG. 1 and FIG. 2, the printing apparatus 1 includes a conveyance roller 2, a pinch roller 3, a platen 4, a discharge roller 5, a spur 6, a printing head 7, an ink tank 8, a carriage 9, an upper-side guide rail 10, a lower-side guide rail 11, a driving belt 12, and the like. A sheet S fed from a sheet automatic feeding apparatus (not illustrated) for separating loaded sheets one by one is held by the conveyance roller 2 and the pinch roller 3, and by rotation of the conveyance roller 2 and the pinch roller 3, the sheet S is conveyed in a conveyance direction ("y" direction in FIGS. 1, 2) to thereby be supplied between the printing head 7 and the platen 4. A driving force of a carriage driving motor 14 is transmitted to the carriage 9 via the driving belt 12, and with this arrangement, the carriage 9 reciprocates along the upper-side guide rail 10 and the lower-side guide rail 11 in an "x" direction illustrated in FIGS. 1 and 2. The printing head (inkjet printing head) 7 is mounted in the carriage 9. An ejection opening (ejection opening 71 illustrated in FIG. 3) is provided on a face (ejection opening face 72 illustrated in FIG. 3) of the printing head 7, facing the sheet S. Along with the movement of the carriage 9, an image is printed on the sheet S, by the ejection of the ink from the ejection opening 71 of the printing head 7 according to a print signal. The printed sheet S is held by the discharge roller 5 and the spur 6, and is then discharged outside the printing apparatus 1.

In the printing apparatus 1, a position of the carriage 9 illustrated in FIG. 1 is a home position thereof, and the carriage 9 is controlled to be positioned at the home position after the completion of printing or the like. A recovery apparatus 13 is arranged at the home position, and a recovery action for recovering the ejection performance of the ejection opening of the printing head 7 is executed on the printing head 7 at the home position. This recovery action includes a suction-recovery action for suctioning and discharging the ink from the ejection opening, and a wiping action for wiping the ejection opening face. In order to execute the actions described above, the recovery apparatus 13 includes a capping mechanism and a wiping mechanism.

Figure 3:
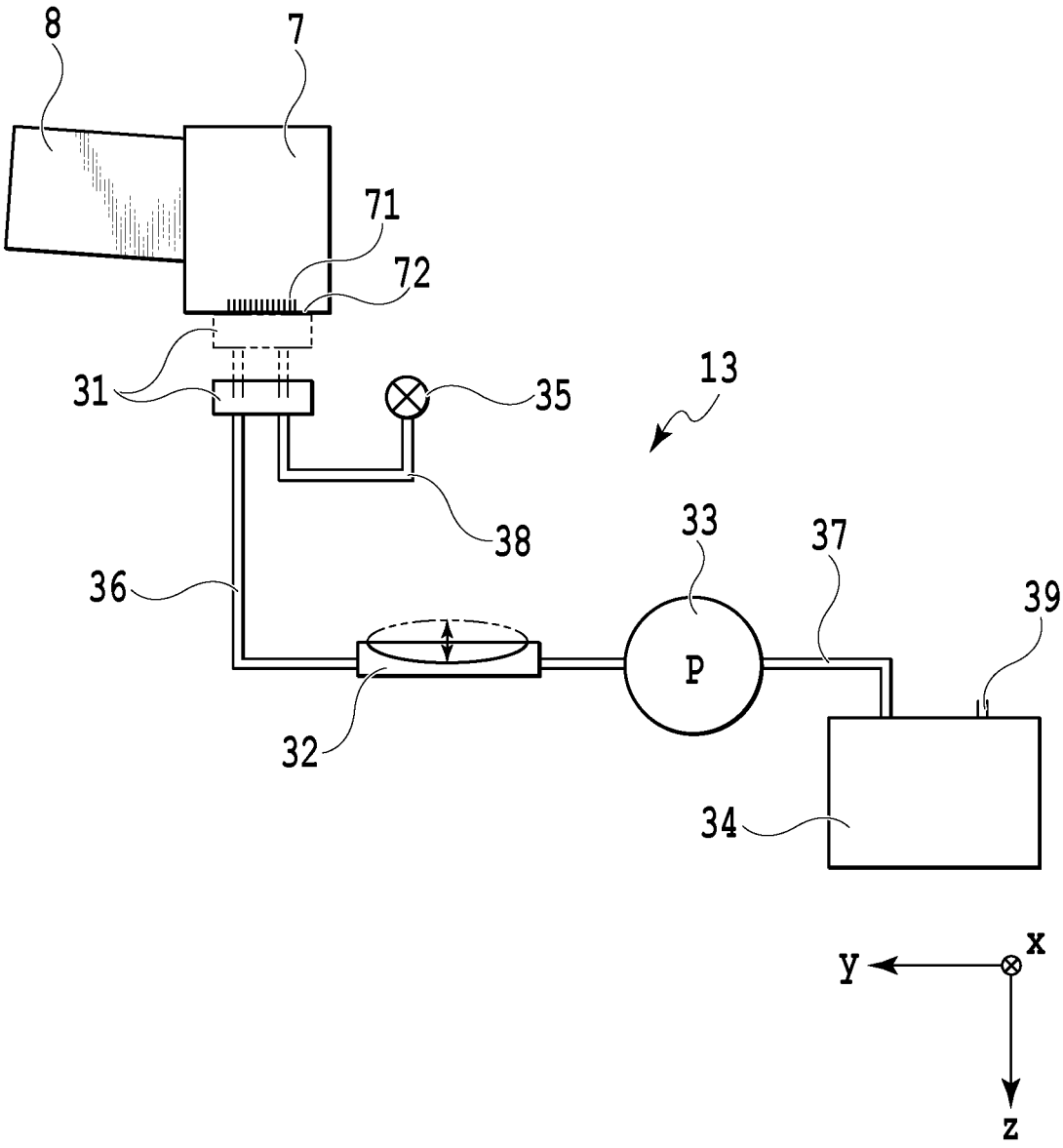
FIG. 3 is a diagram for explaining a configuration of a recovery apparatus.

FIG. 3 is a diagram for explaining a configuration of the recovery apparatus 13. As illustrated in FIG. 3, the recovery apparatus 13 includes a cap 31, a buffer (buffer member) 32, a pump 33, a waste-ink tank 34, a valve 35, and the like.

Due to influence of a usage state or the like of the printing head 7, air bubbles are generated in an ink-flow path communicating with the ejection opening 71 or the concentration of the ink becomes higher along with the advancement of ink drying, and thus a part of ink may be no more suitable for printing an image. In order to remove the ink described above, the suction-recovery action is executed.

The details will be described below. The ejection opening face 72 of the printing head 7 is sealed with the cap 31, furthermore the valve 35 is closed, the pressure in the cap 31 is reduced by activation of the pump 33, and the ink or the like at the ejection opening 71 and around the ejection opening 71 is drawn into the cap 31 to thereby be discharged into a waste-ink tank 34. After the suction-recovery action, the wiping action for wiping the ejection opening face 72 by using a wiper is executed. This action can prevent a case where the ink is not ejected in a desired direction from the ejection opening 71, or a case where the ink is prevented from being ejected, due to adhesion of ink having an increased viscosity at the ejection opening 71 and around the ejection opening 71.

As illustrated in FIG. 3, here, the buffer 32 and the pump 33 are provided between the cap 31 and the waste-ink tank 34. The cap 31 and the pump 33 are connected with each other via the flow path 36, and the pump 33 and the waste-ink tank 34 are connected via the flow path 37. The buffer 32 is provided in the middle of the flow path 36 connecting the cap 31 with the pump 33. Furthermore, the cap 31 is connected with the valve 35 via the flow path 38. According to the present embodiment, each flow path is constituted of a tube.

The cap 31 is, through being driven by a driving source not illustrated, configured to be movable in a "z" direction to a position where the cap 31 covers and seals the ejection opening face 72 of the printing head 7 or a position where the cap 31 is separated away from the ejection opening face 72, and is configured to be capable of sealing the ejection opening face 72. The valve 35 is configured to be capable of being opened or closed through being driven by a driving source not illustrated. The waste-ink tank 34 is provided with a through-hole 39, and thus the waste-ink tank 34 is opened to the air via the through-hole 39.

Figure 4A:
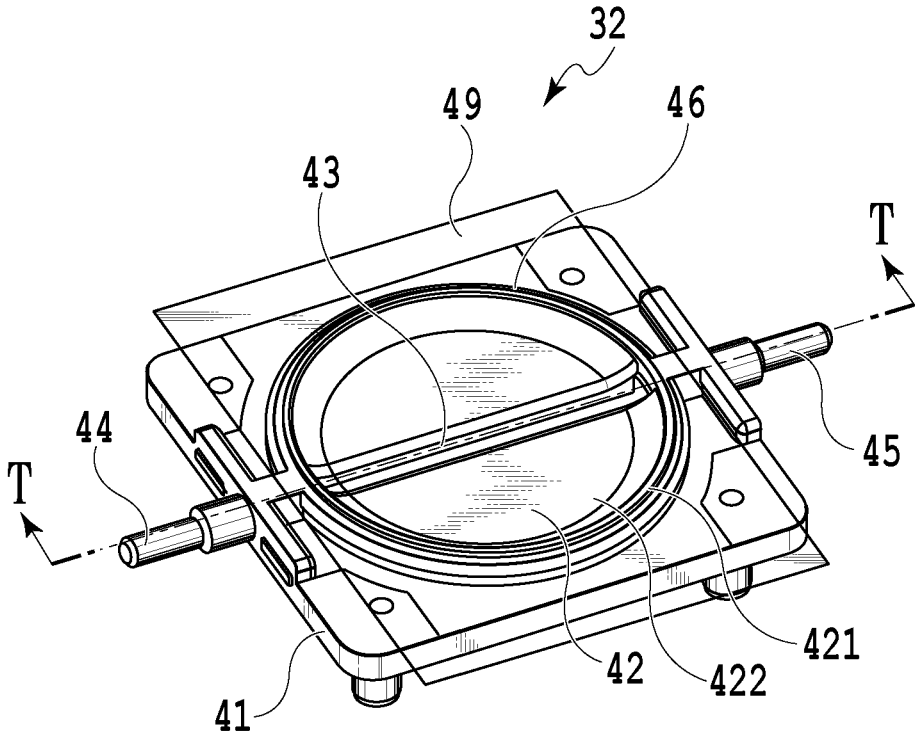
FIG. 4A is a diagram for explaining a configuration of a buffer.
Figure 4B:
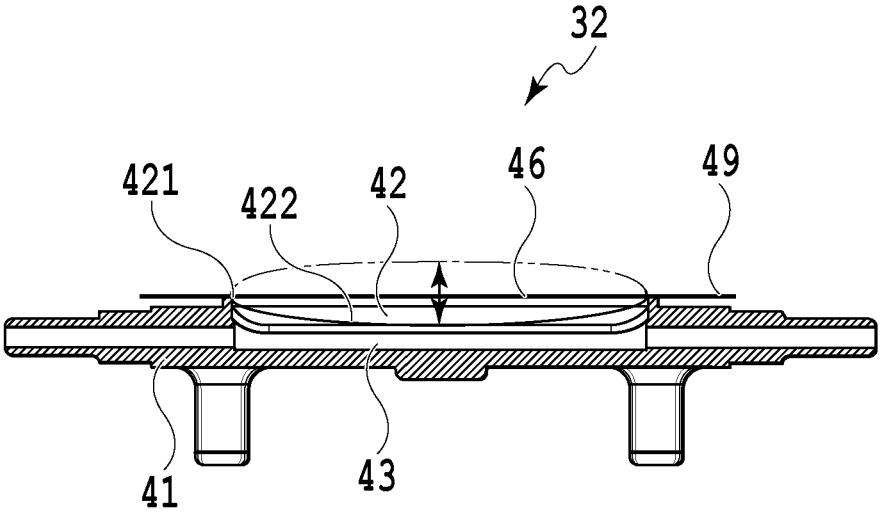
FIG. 4B is a diagram for explaining the configuration of the buffer.

FIG. 4A is a perspective view illustrating a configuration of the buffer 32. FIG. 4B is a cross-sectional view along a line T-T illustrated FIG. 4A. As illustrated in FIGS. 4A, 4B, the buffer 32 includes a case 41, a recessed portion 42, a flow passage groove 43, joint portions 44 and 45, a rib 46, and a film 49.

The case 41 is a hard member. The case 41 is formed with a recessed portion 42 having a bowl-like geometry of a substantially half ball, and an edge 421 of the recessed portion 42 is formed with a rib 46. The joint portions 44 and 45 are each provided at both end portions of the case 41 in a predetermined direction, the joint portion 44 is connected to the flow path 36 on a side of the cap 31, and the joint portion 45 is connected to the flow path 36 on a side of the pump 33. Here, each of the joint portions 44 and 45 are constituted of a tube. The flow passage groove 43 is the flow path connecting the joint portion 44 with the joint portion 45, and is integrally formed on a bottom face 422 of the recessed portion 42. The film 49 has flexibility, and is airtightly welded to the rib 46 in a loosened state.

Figure 5:
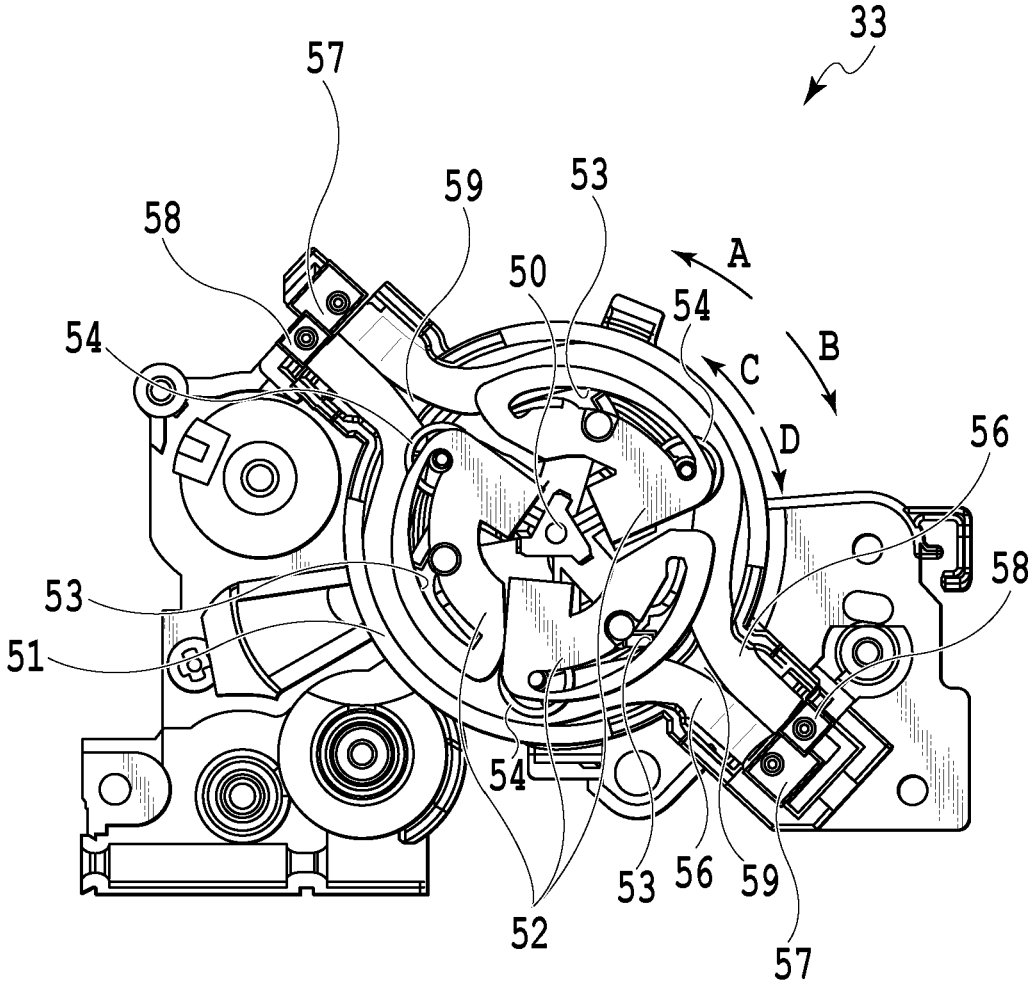
FIG. 5 is a cross-sectional view for explaining a configuration of a pump.

FIG. 5 is a cross-sectional view for explaining a configuration of the pump 33. The pump 33 is a tube pump in which, by moving the roller while crushing an elastic tube, the fluid in the inside of the tube is pushed out and the inside of the tube is made into a negative pressure by a recover force of the tube after being crushed, with the result that the fluid is suctioned. As illustrated in FIG. 5, the pump 33 includes a base 51, a roller wheel 52, a roller 54, a tube 56, and joint portions 57 and 58. Negative pressure is pressure lower than atmospheric pressure.

The base 51 has a cylindrical geometry, and two elastic tubes 56 are stored in the base 51. The tube 56 is arranged along an inner face of the base 51, with the inner face thereof as a guide face. Specifically, the two tubes 56 are arranged one by one along each of the two inner faces having circular-arc geometries of the base 51. The joint portion 57 for connecting to the flow path 36 is provided at one end portion of each tube 56, and the joint portion 58 for connecting to the flow path 37 is provided at another end portion.

The roller wheel 52 is rotatably supported by the axis 50, and is connected to a driving motor not illustrated. According to the present embodiment, three roller wheels 52 are arranged in the base 51. The three roller wheels 52 are each formed with a slit 53 having long-hole geometry along the inner face of the base 51. The roller 54 is incorporated in the roller wheel 52 so as to be capable of autorotating and of moving along the slit 53. The slit 53 is formed such that a distance from the axis 50 that is a center of the base 51 to a rotational axis of the roller 54 engaged with the slit 53 varies. More specifically, the slit 53 is formed such that the more the roller 54 is directed to a side of an arrow C direction of the slit 53 illustrated in FIG. 5, the closer the rotational axis of the roller 54 gets to the axis 50, and the more the roller 54 is directed to a side of an arrow D direction of the slit 53, the farther the rotational axis of the roller 54 goes away from the axis 50.

Furthermore, the tube 56 is arranged between the inner face of the base 51 and the roller 54, and the roller 54 can come into contact with the tube 56. Here, since the slit 53 has a geometry as described above, in the case where the roller 54 is moved to a side of the D direction of the slit 53, the roller 54 presses the tube 56 to thereby squeeze the tube 56 while increasing a pressing force by the roller 54 to the tube 56 along with the movement. On the other hand, in the case where the roller 54 is moved to the side of the C direction of the slit 53, the pressing state is released while the pressing force of the roller 54 to the tube 56 is reduced along with the movement of the roller 54. Namely, the roller 54 can be moved between the pressing position where the tube 56 is pressed and the non-pressing position where the tube 56 is not pressed.

Subsequently, the suction-recovery action for recovering the ejection performance of the printing head 7 with reference to FIGS. 3 to 5 will be described.

The cap 31 illustrated in FIG. 3 is moved upward by the driving force from the driving source not illustrated, the ejection opening face 72 is covered and sealed with the cap 31, and the valve 35 is opened to thereby be exposed to the atmosphere. The driving motor not illustrated is rotated, and the roller wheel 52 is rotated in an arrow A direction illustrated in FIG. 5. Then, the rotation of the roller wheel 52 causes the roller 54 to move away from the axis 50 along the slit 53 by a friction force between the roller 54 and the tube 56. While the roller 54 is being moved, the roller 54 crushes the tube 56 and the pump 33 acts in the same way as the suction action. However, since the valve 35 is in a state of being opened to the air, the ink or the like is not suctioned from the ejection opening 71 or the ejection opening face 72. In this state, the tube 56 is squeezed by the roller 54, the inside of the tube 56 is put into a negative pressure state, and thus the inside of the buffer 32 connected to the tube 56 reaches a negative pressure state against the outside. Therefore, the film 49 has a recessed geometry along the recessed portion 42.

Next, while maintaining a state where the ejection opening face 72 is covered with the cap 31, the valve 35 is closed and the inside of the cap 31 is sealed. The roller wheel 52 is further rotated by a predetermined amount in the arrow A direction (one direction) illustrated in FIG. 5, and the tube 56 is squeezed by a pressing force along with the move of the roller 54, and the ink and the air bubbles are suctioned from the ejection opening 71 or the like.

After the predetermined amount of fluid is suctioned, the valve 35 is opened to thereby be exposed to the atmosphere while the sealed state of the ejection opening face 72 is maintained by using the cap 31, and the roller wheel 52 is rotated in the arrow A direction illustrated in FIG. 5 by the rotation of the driving motor not illustrated. As described above, the ink filled in the cap 31 is suctioned, and is discharged into the waste-ink tank 34 via the flow paths 36 and 37, by activation of the pump 33. During this action also, since the flow path 36 has a negative pressure, the film 49 has a recessed geometry along the recessed portion 42. Even in this case, since the buffer 32 is formed with the flow passage groove 43 and the flow path for allowing the flow of the suctioned ink is secured, ink and the like suctioned into the cap 31 can be discharged into the waste-ink tank 34. Furthermore, during this action, since the film 49 is maintained in a recessed geometry along the recessed portion 42, a suction pressure and an amount of suction can be stably controlled without varying the volume of the fluid flowing in the recovery apparatus 13, with the result that maintenance of the printing head 7 can be performed under appropriate conditions.

The cap 31 is separated away from the ejection opening face 72 by moving the cap 31 downward by the driving source not illustrated. After that, by rotation of the driving motor not illustrated, the roller wheel 52 is rotated in the arrow B direction (another direction) illustrated in FIG. 5, and the roller 54 is moved in a direction of approaching the axis 50 by the friction force between the roller 54 and the tube 56. With this arrangement, while gradually weakening and decreasing the pressing force by the roller 54 to the tube 56, a pressing state by the roller 54 to the tube 56 is finally released.

A pressing state by the roller 54 to the tube 56 is released in order to suppress a change of the suction performance of the tube 56 due to a creep and in order to avoid the fact that the flow path 36 from the cap 31 to the pump 33 is put into a sealed state in a state where the cap 31 seals the ejection opening face 72. As to the latter, specifically, in the case where the flow path 36 is in the sealed state, the volume of the fluid in a sealed space varies due to a change of ambient temperature, and thus the meniscus at the ejection opening 71 is destroyed and ink may not be able to be ejected from the ejection opening 71. To prevent such a situation, the pressing state by the roller 54 to the tube 56 is released.

Note that, for example, in the case where a recovery force of the tube 56 is abated due to aging, the friction force between the roller 54 and the tube 56 is abated and thus it can be considered that the pressing force to the tube 56 cannot be released in a region where the tube 56 is laid along the base 51. However, according to the present embodiment, since an angle is changed at which the roller 54 and the tube 56 come into contact with each other at a change point 59 of laying the tube 56, a force for moving the roller 54 along the slit 53 is applied to the roller 54. With this force, even in the case where the recovery force of the tube 56 is abated, the roller 54 is moved along the slit 53 and thus the pressing state by the roller 54 to the tube 56 can be released.

As described above, according to the present embodiment, while the roller 54 is moved along the slit 53 having a long-hole geometry and having different distances from the axis 50 depending on the position, the pressing force by the roller 54 to the tube 56 is changed. In the case where the pressing state by the roller 54 to the tube 56 is released, the pressing state where the roller 54 presses the tube 56 is gradually shifted to the non-pressing state where the roller 54 does not press the tube 56, along with move of the roller 54. Namely, in the case where the pressing state is released, the pressing state cannot be released without changing a relative position between the roller 54 and the tube 56, from the position where the tube 56 is pressed. Therefore, the backflow that pushes out the fluid toward the side of the cap 31 is generated in the pump 33, by the movement of the roller 54 in the direction of approaching the axis 50 associated with the turning of the roller wheel 52 in the arrow B direction illustrated in FIG. 5.

In the case where ink remains in the cap 31, if the fluid flowing back reaches the cap 31, air bubbles may be generated in the ink in the cap 31. In the case where the air bubbles are generated in the ink in the cap 31 and then, the cap 31 covers the ejection opening face 72, there may be generated a case where the mixed color in which inks having different colors are mixed by the contact of the air bubbles with the ejection opening 71. Furthermore, the meniscus formed at the ejection opening 71 may be destroyed by the contact of the air bubbles with the ejection opening 71, a gas flows in the ejection opening 71, and there may be generated a non-ejection of ink in which the ink is not ejected but the gas is ejected, from the ejection opening 71. As described above, in the case where the backflow of the fluid is generated, ink of a desired color may not be applied to the sheet S, or the ink may not be applied thereto, and thus image quality may be deteriorated.

In order to prevent the deterioration, according to the present embodiment, the provision of the buffer 32 between the cap 31 and the pump 33 suppresses influence by the fluid flowing from the pump 33 to the cap 31, which is generated in the case of releasing the pressing state to the tube 56. More specifically, in the case where the fluid flows back by rotary driving of the pump 33 in a direction opposite to that at the time of the suction action, the film 49 of the buffer 32 is expanded as a dotted line illustrated in FIG. 4B, and the fluid flowing back is stored in the buffer 32. Details will be described below, but here, even in the case where the ink remains in the cap 31, the buffer 32 is configured not to generate air bubbles in the ink. Therefore the influence by the fluid flowing back is suppressed.

The buffer 32 is configured such that a volume of the buffer 32 can be changed by deforming the film 49, and has the volume that can store an estimated maximum volume of the fluid flowing back. According to the present embodiment, the buffer 32 and the pump 33 are configured such that an amount of volume variation in the buffer 32 due to deformation of the film 49 is to be 930 cubic millimeters, and a maximum volume of the fluid flowing back from the pump 33 is to be 450 cubic millimeters.

Here, features of the ink used for the present embodiment will be described. The ink includes surface-active agent and polymer, and foaming property and defoaming property may vary depending on their contents and their types. According to the present embodiment, there is used ink having a property of comparatively easily foaming and hardly defoaming. In the case where this ink is used, and in the case where difference in the pressure between an inside of the cap 31 and an inside of the flow path 36 exceeds 2.1 kPa by the increase in pressure due to the backflow of the fluid of the pump 33, the air bubbles are generated in the ink in the cap 31, in a state where the valve 35 is opened to thereby be exposed to the atmosphere.

According to the present embodiment, the configuration of the buffer 32 is determined so as not to reach a pressure generating the air bubbles in the cap 31, that is, so as to come to the difference in a pressure that is less than the difference in a pressure that generates the air bubbles in the cap 31. More specifically, the buffer 32 is configured by setting sizes of the case 41, the recessed portion 42, the flow passage groove 43, the film 49, and the like such that the difference in the pressure between the inside of the buffer 32 and the inside of the flow path 36 is to be substantially 1 kPa or less at the time of the maximum expansion of the film 49. Even in the case where the ink that comparatively easily foams and hardly defoams is used as in the present embodiment, the generation of the air bubbles in the ink in the cap 31 due to the backflow of the fluid can be prevented by configuring the buffer as described above, with the result that the influence by the backflow of the fluid can be suppressed.

In the case where the pressing state by the roller 54 to the tube 56 is released, the flow path from the cap 31 to the waste-ink tank 34 is exposed to ambient conditions by the through-hole 39 of the waste-ink tank 34.

The wiping action is executed after the suction-recovery action is executed. In the wiping action, the ejection opening face 72 is wiped using a wiper blade (not illustrated); ink, dust, and the like adhering to the ejection opening face 72 are removed; and thus the ejection opening face 72 is cleaned. During the wiping action, the cap 31 is in a state of being separated away from the ejection opening face 72. After the wiping action is finished, in order to prevent the ejection opening 71 from getting dry, the cap 31 is moved upward by the driving source not illustrated to thereby cover the ejection opening face 72, and thus the recovery action is finished.

According to the present embodiment, there has been described the buffer constituted by welding the flexible film member to the case that is a hard member, but the configuration of the buffer is not limited to the configuration described above. There may be adopted a configuration in which the volume can be changed depending on the difference in the pressure between an inside and an outside of, for example, a bag-like film, a piston, a container having bellows shape, and the like. Namely, the configuration of the buffer is not particularly limited as long as the volume of the fluid flowing back is suctioned, and the generation of the air bubbles or the like can be prevented in the ink in the cap.

According to the present embodiment, with reference to the drawings, the recovery apparatus of one system has been described, but the recovery apparatus of a plurality of systems or a plurality of recovery apparatuses may be used. Even in this case, in the same way as the present embodiment, the buffer is provided between the cap and the pump, the fluid flowing from the pump to the cap is stored in the buffer, with the result that the influence by the fluid flowing back can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-168525 filed Aug. 21, 2014, which is hereby incorporated by reference wherein in its entirety.

What is claimed is:

1. An inkjet printing apparatus comprising:

an inkjet printing head including an ejection opening face formed with an ejection opening;

a cap being capable of sealing the ejection opening face;

a tube pump connected with the cap and configured to be able to generate a negative pressure inside of the cap;

a buffer member provided between the cap and the tube pump and including a bottom face and a film member mounted opposite to the bottom face;

a first flow path that allows the cap and the buffer member to communicate with each other;

a first joint portion that connects the first flow path and the buffer member with each other;

a second flow path that allows the tube pump and the buffer member to communicate with each other;

a second joint portion that connects the second flow path and the tube pump with each other; and a flow passage groove formed at the bottom face and configured to allow the first joint portion and the second joint portion to communicate with each other inside the buffer member.

2. The inkjet printing apparatus according to claim 1, wherein the tube pump includes a tube connected to the cap and a roller being movable between a pressing position where the tube is pressed by the roller and a non-pressing position where the tube is not pressed by the roller, and the roller is configured to be movable to the pressing position by rotation of the tube pump in one direction and to be movable to the non-pressing position by rotation of the tube pump in another direction.

3. The inkjet printing apparatus according to claim 1, wherein the buffer member is configured to be capable of modifying a volume by deforming the film member by a difference in pressure between an inside of the buffer member and an inside of the first flow path or the second flow path.

4. The inkjet printing apparatus according to claim 3, wherein the flow passage groove permits a flow of a fluid regardless of variation in a volume of the buffer member.

5. The inkjet printing apparatus according to claim 4, wherein the buffer member is configured such that, in a case where the volume of the buffer member becomes maximum, the difference in pressure between the inside of the buffer member and the inside of the first flow path or the second flow path does not generate air bubbles in ink inside the cap.

6. The inkjet printing apparatus according to claim 5, wherein a maximum volume of the buffer member is capable of storing an estimated maximum volume of the fluid flowing from the tube pump to the cap.

7. The inkjet printing apparatus according to claim 3, wherein the buffer member includes a recessed portion having an edge;

the edge is formed with a rib; and the film member is welded to the rib.

8. The inkjet printing apparatus according to claim 4, wherein the flow passage groove is integrally formed on the bottom face.

* * * * *